United States Patent [19]

Sfikas

[11] Patent Number: 4,715,728

[45] Date of Patent: Dec. 29, 1987

[54] TAMPER EVIDENT MULTI-PURPOSE ENVELOPE

[76] Inventor: Nicholas Sfikas, 29 Widewaters La., Pittsford, N.Y. 14534

[21] Appl. No.: 65,855

[22] Filed: Jun. 24, 1987

[51] Int. Cl.[4] ..... B65D 33/10; B65D 33/14

[52] U.S. Cl. ..... 383/9; 383/5; 383/22; 383/14; 206/610; 206/632

[58] Field of Search ..... 383/5, 6, 9, 12, 14, 383/17, 22, 23, 25, 26, 30; 206/620, 621, 626, 610, 632

[56] References Cited

U.S. PATENT DOCUMENTS

| | | | |
|---|---|---|---|
| 2,878,849 | 3/1959 | Lingenfelter et al. | 383/9 |
| 3,079,066 | 2/1963 | Roop | 206/632 |
| 3,251,390 | 5/1966 | Evans | 383/14 |
| 3,462,069 | 8/1969 | Suominen | 383/9 |
| 3,646,723 | 3/1972 | Meroney | 383/9 |
| 3,685,720 | 8/1972 | Brady | 206/632 |
| 3,727,829 | 4/1973 | Hiini | 206/610 |
| 4,615,045 | 9/1986 | Siegel | 383/5 |

FOREIGN PATENT DOCUMENTS

| | | | |
|---|---|---|---|
| 197869 | 11/1938 | Switzerland | 206/610 |

*Primary Examiner*—Willis Little

*Attorney, Agent, or Firm*—Shlesinger, Arkwright & Garvey

[57] ABSTRACT

This invention relates to a transparent plastic envelope which has presealed therein display material visible through the envelope. The envelope is designed so as to provide both means for hanging the envelope up on a hook or the like as well as means for positioning the envelope in a ring notebook binder. Both the flap for the hook engaging means and the flap for positioning on the rings of a binder are initially sealed into the plane of the envelope and the envelope is provided with means for breaking the seal to permit the flaps to hinge outwardly for proper positioning either for hanging or inserting into the notebook binder.

27 Claims, 11 Drawing Figures

TAMPER EVIDENT MULTI-PURPOSE ENVELOPE

BACKGROUND OF THE INVENTION

Sealed envelopes have been used for preserving identification cards, drivers licenses and the like. In a typical lamination process, the information to be preserved is sandwiched between two transparent plastic layers which are secured around the periphery. In this way the outer plastic laminate layers protect the insert.

The prior art such as Wilburger U.S. Pat. No. 1,446,232, Nystrom U.S. Pat. No. 1,683,479, Huni U.S. Pat. No. 3,727,829, and Sengewald U.S. Pat. No. 4,015,771 provided perforations for insert into pins for ring binders or the like.

In particular, Huni U.S. Pat. No. 3,727,829 and Roop U.S. Pat. No. 3,079,066 provide hinged overlying flaps with openings therein.

Farmer U.S. Pat. No. 2,093,977 also shows the idea of providing a flap laminate which folds backward from the hinge to provide a handle or support means for the receptacle. In the Huni and Roop patents, the flap is formed from the rear sheet rather than from the front sheet. Lefebvre U.S. Pat. No. 2,833,401 provides a sealed flap. Geimer U.S. Pat. No. 1,947,934 provides a sealed flap with perforations therein.

The need has existed for a sealed transparent envelope which can be supported on a hook or the like for display purposes in stores and which also may be positioned in a ringed notebook binder.

OBJECTS AND SUMMARY OF THE INVENTION

It is a primary object of this invention to provide a laminated transparent sealed envelope which is provided with means for hanging on a hook or board or the like, as well as means for positioning in a multi-ringed notebook binder.

Yet another object of this invention is to provide means in the sealed envelope which will permit easy breaking of the seal in order to afford ready access to the material therein.

A further object of this invention is to provide an envelope with a flap having a second flap sealed therein with means for readily breaking the seal of the second flap to enable the second flap to be positioned on a hook or the like without breaking the seal of the first flap.

Yet a further object of this invention is to provide an envelope which is inexpensive and easily manufactured.

A further object of this invention is to provide a single hinge means for both the first and second flaps.

Yet a further object of this invention is to provide a flexible transparent envelope having opening means at the top thereof to provide ease in access to the material therein which can be readily reclosed once the material has been removed.

In summary, this invention pertains to a transparent plastic envelope having at the top a sealed main flap with a second flap positioned therein and with means for breaking the seal on both the first and second flaps to provide a hanger as well as means for inserting the envelope into a multi-ringed notebook binder.

DESCRIPTION OF DRAWINGS

The above objects and advantages and novel features of the present invention will become apparent from the following detailed description of the invention illustrated in the accompanying drawings, wherein.

DESCRIPTION OF FIGS. 1 through 5

Figure 3:
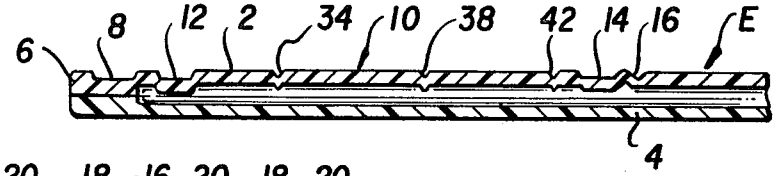
FIG. 3 is a fragmentary cross-sectional view enlarged at and taken along the lines 3—3 and viewed in the direction of the arrows.

In the preferred form of the invention, the envelope E is made from plastic laminated sheet material bonded by heat. As best shown in FIG. 3, the envelope E comprises an upper laminate sheet 2 and a lower laminate sheet 4. The sheets are bonded at 6.

The entire periphery of the envelope E is provided with a heat seal 8. This heat seal 8 laminates the upper and lower sheets 2 and 4 together.

Figure 3A:
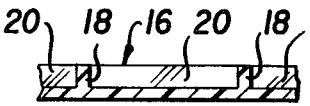
FIG. 3A is an enlarged fragmentary cross-sectional view taken along the lines 3A—3A and viewed in the direction of the arrows.

At the top of the envelope E is a first flap 10 The flap 10 includes a hinge 12. The hinge 12 is formed in the upper laminate sheet 2 prior to lamination to the lower laminate sheet 4. At the bottom of the first flap 10 is located an indentation or groove 14. The purpose of the groove 14 is to provide strength to the bottom of the flap 10 so as to avoid tearing when the seal is separated. A score line 16 is formed adjacent the groove 14. The score line 16, as best shown in FIG. 3A, is scored approximately two-thirds of the way through the plastic of the upper laminate sheet 2. Periodically small webs 18 are positioned between the scores 20 so that accidental rupturing of the envelope will not occur without fracturing of the webs 18.

Figure 4:
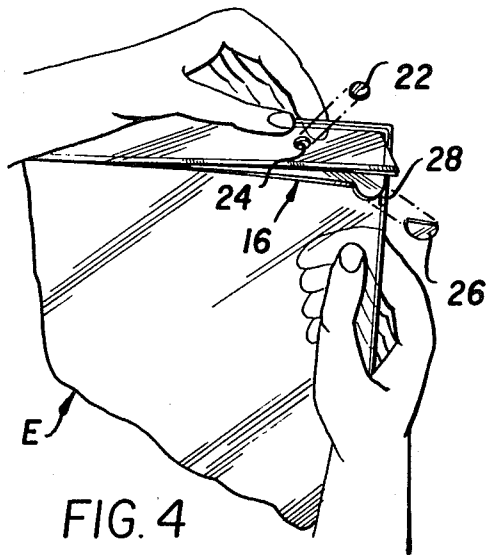
FIG. 4 is a fragmentary elevation operatively showing breaking of the seal of the envelope.

The first flap 10 is provided with perforation popouts 22 which are partially scored for ease in removal to form the perforation 24 as best shown in FIG. 4. The perforations 24 are provided for positioning the first flap 10 on the rings of a notebook binder (not shown).

As best shown in FIG. 4, half-moon shaped popouts 26 are provided at the lower corners of the first flap 10 for ease in breaking the seal of the envelope E. At the score line 16 are reinforcement seals 28 which abut the heat seal 8. The reinforcements 28 prevent tearing of the envelope E in the area of the popouts 26 due to frequent insertion or removal of the information originally sealed in the envelope E.

It should be noted, that the first flap 10, lies in the plane of the upper laminate sheet 2 and extends downward from the hinge 12. When the flap 10 is opened fully, it can be swung approximately 180° about the hinge 12 which is located below the seal 8. The score line 16 extends from the bottom edge of the flap 10 upwardly on either side of the flap as at 30 and includes webbing (not shown) similar to the webs 18 located between the scores 20 of FIG. 3A. The hinge 12 and the heat seal in the areas of the score lines 30, prevent tearing off of the flap 10.

Figure 2:
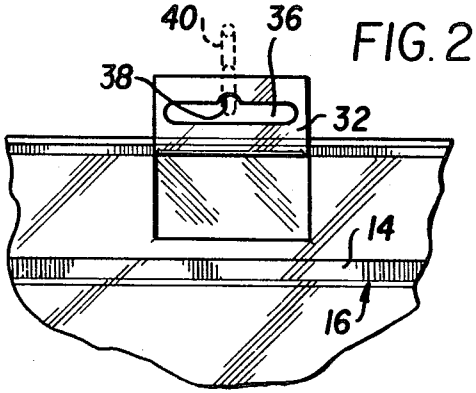
FIG. 2 is a fragmentary top plan view showing the hook support member bent backward in vertical position to receive a hook shown in phantom lines.
Figure 1:
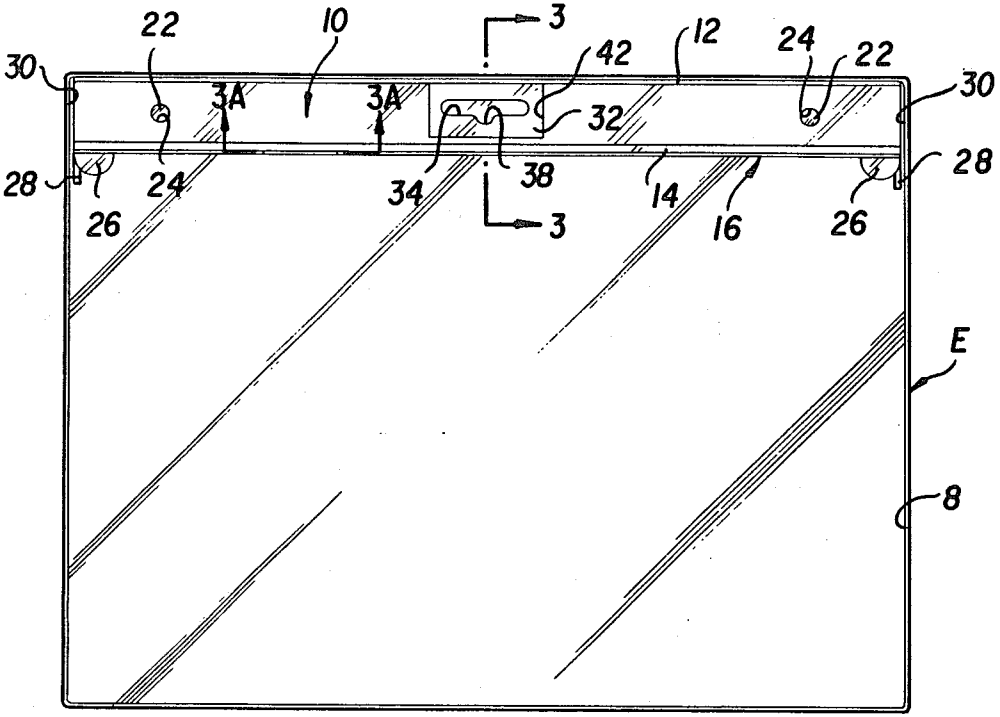
FIG. 1 is a top plan view of the envelope of the invention.

The first flap 10 is provided with a second flap or hanger 32 as best shown in FIG. 1. The second flap 32 includes a perforation popout 34 providing an opening 36 as best shown in FIG. 2. The opening 36 includes a recess 38 for supporting a hook 40 as shown in FIG. 2. A score line 42 similar to score line 16 is provided in the first flap 10 with webs similar to 18 shown in FIG. 3A. These score lines 18 as mentioned above, prevent premature rupturing of the score prior to the intended use of the second flap or hanger 32. It will be noted in FIG. 2 that the second flap 32 hinges on hinge line 12 as does also the first flap 10. It will be thus obvious that the hinge 12 of the second flap 32 is positioned below the seal 8. Thus, the second flap 32 when in use, will bend backward about the hinge 12 in the manner of the flap 10.

The opening 36 cooperates with the perforations 24 to provide, were necessary, a receptacle for a third ring in a standard three ring notebook binder. Thus, the opening 36 is in line with the perforations 24.

Figure 5:
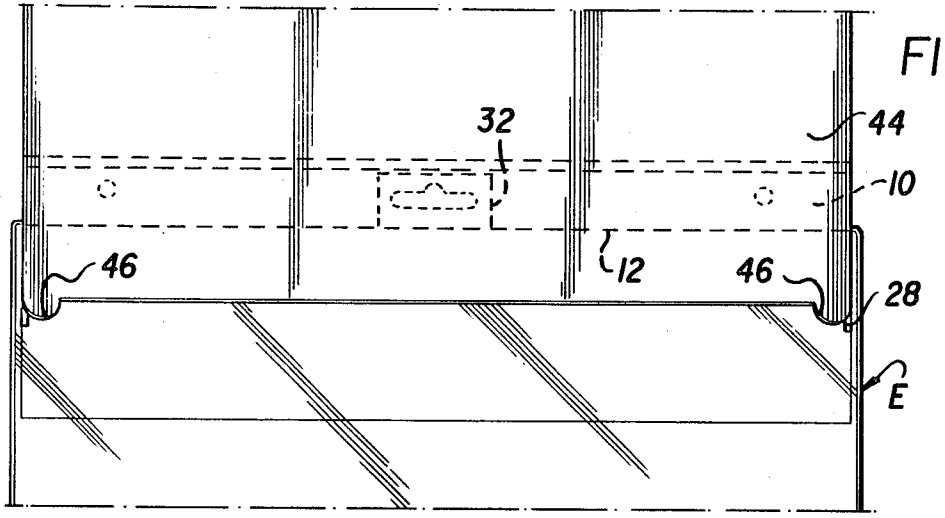
FIG. 5 is a fragmentary top plan view showing removal or insertion of a document after the seal has been broken.

In FIG. 5, an insert 44 is shown positioned a portion of the way into the envelope E with the first flap 10 and second flap 32 hinged upwardly about the hinge 12. The notches 46 assist in making it easy to remove or insert any material such as the insert 44.

DESCRIPTION OF FIGS. 6 through 9

Figure 6A:
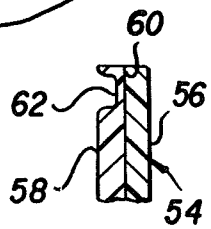
FIG. 6A is an enlarged cross-sectional view taken along the lines 6—6 of FIG. 6 and viewed in the direction of the arrows.
Figure 6:
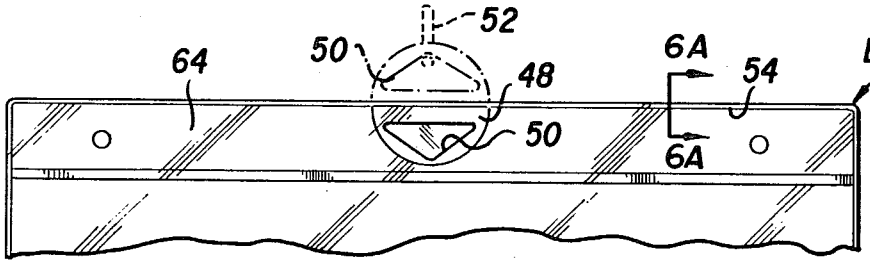
FIG. 6 is a top plan fragmentary view showing a modification of the invention with the hanger shown in a hooked position in phantom lines.
Figure 7:
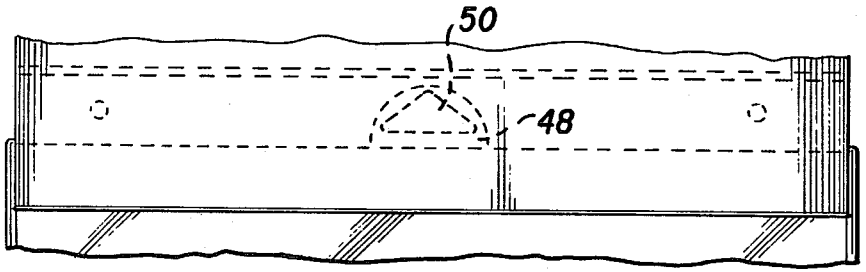
FIG. 7 is a fragmentary top plan view of the modification of FIG. 6 showing an insert being removed or inserted into the envelope.

FIGS. 6 and 7 show a modified version of the invention with a second flap or hanger 48 which is provided with a triangular shaped opening 50. At the apex of the triangular opening 50, is positioned a hook 52 as in FIG. 6. In FIG. 6, the hinge line of FIGS. 1 through 5 is deleted and the second flap 48 hinges on the seal line 54.

As best shown in FIG. 6A, the upper sheet 56 is bonded to the lower 58 by a bond 60 formed by the indentation of the heat seal 62. Thus, the seal line 54 in the modification of FIGS. 6 and 7 is on the back of the envelope E at the area of the periphery of the lower sheet 58 rather than on the front of the envelope E as in FIGS. 1 through 5. The hinge for the first flap 64 as well as the second flap 48 is the seal area 60 differing from the structure shown in FIGS. 1 through 5.

Figure 8:
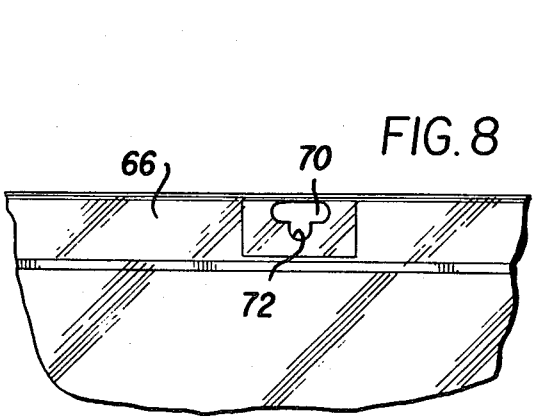
FIGS. 8 and 9 are fragmentary top plan views showing a further modification of the envelope illustrating the hook flap with the hook shown in phantom lines in FIG. 9.
Figure 9:
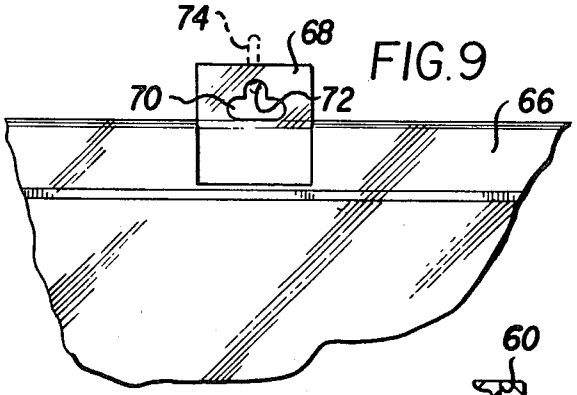

DESCRIPTION OF FIGS. 8 and 9

In FIGS. 8 and 9, the first flap 66 includes a hanger second flap 68. The second flap 68 includes an opening 70 with a notch 72 for a hook 74. The hinge system of FIGS. 8 and 9 is similar to that of FIGS. 6 and 7 in that the hinge comprises the seal line as at 54 in FIGS. 6 and 7 as best shown in FIG. 6A. Both modifications shown in FIGS. 6 through 9 include perforated popouts similar to popout 34 and are scored with reinforcement webs similar to webs 18 and scores 20 shown in FIGS. 1 through 5.

Whereas the opening 50 is centered in the second flap 48 in FIGS. 6 and 7, the opening 70 has its upper edge as shown in FIG. 8, bordering on the hinge seal 54.

While this invention has been described as having a preferred design, it is understood that it is capable of further modifications, uses and/or adaptions of the invention following in general the principle of the invention and including such departures from the present disclosures as come within known or customary practice in the art to which the invention pertains, and as may be applied to the essential features hereinbefore set forth, and fall within the scope of the invention of the limits of the appended claims.

What I claim is:

1. A substantially planar multipurpose envelope for use in a multi-ringed notebook binder comprising:

(a) a first substantially planar hinged flap normally positioned in the place of said envelope and hingedly movable out of the plane of said envelope;

(b) said first flap having first ring binder mounting means for supporting said envelope in a multi-ringed binder when said first flap is positioned out of the plane of said envelope;

(c) said first flap having a second hinged flap integral therewith and contained therein and normally positioned in the plane of said first flap and hingedly movable out of the plan of said first flap;

(d) said second flap including hanger mounting means for hanging said envelope up when said second flap is positioned outside of the plane of said first flap; and (e) said second flap being independently pivotable of said first flap.

2. An envelope as in claim 1, wherein:

(a) said first flap is movable through 180°.

3. An envelope as in claim 1, wherein:

(a) said second flap is movable through 180°.

4. An envelope as in claim 1, wherein:

(a) said envelope includes edges and sides; and (b) said envelope is completely sealed at all edges and sides.

5. An envelope as in claim 4, wherein:

(a) said first and second flaps form with at least one of said sides, a sealed side.

6. An envelope as in claim 5, wherein:

(a) said envelope includes rupturable means for breaking the seal of said at least one of said sides for moving said first and second flaps out of the plane of said envelope and first flap respectively.

7. An envelope as in claim 6, wherein:

(a) said rupturable means includes tab means positioned in said at least one of said sides adjacent said first flap for initiating the rupture of said rupturable means.

8. An envelope as in claim 7, including;

(a) removable plug means on said first flap for providing openings for receiving said rings of said multi-ringed binder.

9. An envelope as in claim 8, including:

(a) removable plug means in said hanger mounting means for providing an opening in said second flap for receiving said hanger for hanging said envelope.

10. An envelope as in claim 7, wherein:

(a) said envelope includes top, bottom, and side edges; and (b) said first and second flaps are located adjacent said top edge.

11. An envelope as in claim 5, wherein:

(a) said envelope includes a pair of sheets edge sealed; and (b) said rupturable means includes score lines partially scored through at least said one of said edge sealed sheets in said at least one of said sides adjacent said first flap.

12. An envelope as in claim 5, wherein:

(a) said envelope includes a pair of sheets edge sealed; and (b) said rupturable means includes score lines partially scored through at least one of said edge sealed sheets in said at lest one of said sides adjacent said second flap.

13. An envelope as in claim 11, wherein:

(a) said scoring is intermittent providing small webs to prevent accidental rupturing of said envelopes.

14. An envelope as in claim 12, wherein:

(a) said scoring is intermittent providing small webs to prevent accidental rupturing of said envelope.

15. An envelope as in claim 7, wherein:

(a) said tab means are positioned at the ends of said first flap.

16. An envelope as in claim 15, including:

(a) reinforcing means adjacent said tab means to prevent accidental tearing of said envelope at said first flap.

17. An envelope as in claim 1, wherein:

(a) said envelope is made of plastic.

18. An envelope as in claim 17, wherein:

(a) said plastic is transparent.

19. An envelope as in claim 18, wherein:

(a) said first and second hinged flaps include linear integral heat formed plastic indented hinges.

20. An envelope as in claim 9, wherein:

(a) said opening in said hanger mounting means is generally T-shaped with the bottom of said T adapted to engage said hanger.

21. An envelope as in claim 9, wherein:

(a) said opening in said hanger mounting means in generally triangular in shape with the apex of said triangle adapted to engage said hanger.

22. An envelope as in claim 20, wherein:

(a) said tab means includes a top and bottom; and (b) said T-shaped hanger mounting means is positioned at the top of said tab means.

23. An envelope as in claim 20, wherein:

(a) said tab means includes a central area; and (b) said T-shaped hanger mounting means is positioned at said central area.

24. An envelope as in claim 9, wherein:

(a) said opening in said second flap forms a second ring binder mounting means cooperating with said first ring binder mounting means.

25. An envelope as in claim 19, wherein:

(a) said hinges are coaxial.

26. An envelope as in claim 12, wherein:

(a) said edge sealed sheets include a front and a rear sheet; and (b) said first and second flaps are positioned on said front sheet, and have their hinges on said front sheet.

27. An envelope as in claim 12, wherein:

(a) said edge sealed sheets include a front and a rear sheet; and (b) said first and second flaps are positioned on said front sheet and have their hinges on said rear sheet.

* * * * *